United States Patent [19]

Jeruzal et al.

[11] 4,408,642

[45] Oct. 11, 1983

[54] PORTABLE WORKBENCH

[76] Inventors: Thomas M. Jeruzal, 6983 Lafayette; Dennis G. Koski, 6484 Silvery La., both of Dearborn Heights, Mich. 48127

[21] Appl. No.: 268,689

[22] Filed: Jun. 1, 1981

[51] Int. Cl.[3] ..... B27C 5/10

[52] U.S. Cl. ..... 144/286 A; 29/DIG. 102; 184/106; 312/269; 409/137

[58] Field of Search ..... 29/DIG. 101, DIG. 102; 409/135, 136, 137; 144/2 R, 286 R, 286 A, 285; 184/6.14, 106; 34/237; 134/56; 312/269

[56] References Cited

U.S. PATENT DOCUMENTS

| | | | |
|---|---|---|---|
| 477,758 | 6/1892 | Huss . | |
| 1,249,786 | 11/1917 | Leiman et al. . | |
| 1,276,079 | 8/1918 | Kovnat | 184/106 |
| 1,539,051 | 5/1925 | McLean . | |
| 1,808,402 | 6/1931 | Cooper . | |
| 2,654,508 | 10/1953 | Wright | 222/112 |
| 3,007,256 | 11/1961 | Rouy | 34/237 |
| 3,249,954 | 5/1966 | Franckowiak | 184/106 |
| 3,575,481 | 4/1971 | Phlieger, Jr. | 312/228 |
| 4,052,227 | 10/1977 | Delo et al. | 134/56 |
| 4,054,184 | 10/1977 | Marcinko | 184/106 |
| 4,085,987 | 4/1978 | Vartdal | 312/269 |
| 4,265,283 | 5/1981 | Nash et al. | 144/286 R |

*Primary Examiner*—W. D. Bray

*Attorney, Agent, or Firm*—Harness, Dickey & Pierce

[57] ABSTRACT

A portable workbench featuring a stand structure supported by a plurality of wheels, and having a work surface with perforations therein for permitting liquid to drain therethrough, a self-draining catch basin disposed under the work surface to collect the draining liquid, and a removable reservoir connected to the catch basin to store the liquid for subsequent disposal. In one embodiment, the perforated work surface and catch basin form a detachable section for use in conjunction with existing stationary workbenches. The perforated work surface is coupled to the frame structure by a hinge which permits the work surface to swing away from the catch basin for easy access thereto. The position of this hinge and the supporting structure is such that the weight of the work surface and any objects that may be placed thereon is entirely supported by the stand structure and not by the hinge.

16 Claims, 7 Drawing Figures

10
26
43
17
61
16'
12
22
38
37
41
20
18
28
16
32
92
17
66
33
46
14
48
50
49
42
47
70
70
45
25
70
30
32
34

PORTABLE WORKBENCH

BACKGROUND AND SUMMARY OF THE INVENTION

The present invention relates generally to workbenches, and particularly to portable workbenches.

There are many instances where a workbench structure is employed for working on, repairing, or disassembling mechanisms which are portable and greasy, oily, or contain liquid. In such situations, it is desirable to have a workbench structure adapted to catch any liquid dripping or draining from a machine or mechanism in order to avoid slippery floors and messy work surfaces, and to avoid the need to resort to drain pans or rags and other absorbent materials. It is also desirable for the workbench structure to be portable, thereby permitting easy movement of the mechanism to be repaired, disassembled, and so forth.

In view of the above, it is a general object of the present invention to provide an improved workbench structure.

It is another object of the present invention to provide a workbench adapted to catch and store any liquid draining from a mechanism for subsequent disposal.

It is another object of the present invention to provide a workbench which is portable, compatible with existing work areas, and adapted to permit a machine or apparatus to be worked on from all sides.

It is an additional object of the present invention to provide a workbench which is self draining to minimize work time, and includes a removable reservoir for the drained liquid for subsequent disposal.

It is another object of the present invention to provide a portable workbench with a removable upper assembly. The upper assembly, having a perforated work surface and catch basin section, can be used in conjunction with existing workbenches or on-site job applications such as under a motor vehicle. The lower assembly, having a reinforced flat work surface and drain, can be used for carting objects as well as serving as a conventional workbench. Each assembly, by itself, thus provides added usefulness and portability when not used as one unit.

It is another object of the present invention to provide a portable workbench that can be self-assembled yielding a reduction in cost by minimizing the required manufacturing processes and realizing additional savings in warehousing and transportation costs by utilization of low profile, high density packaging.

To achieve these objectives, the present invention provides a novel portable workbench featuring a lower and upper assembly.

The upper assembly has a work surface with perforations therein for permitting liquid to drain therethrough, and a self draining catch basin disposed under the work surface to collect the draining liquid. The catch basin has a drain and stopcock feature to regulate fluid flow and a screen to prevent the loss of small parts which had passed through the perforations of the work surface. The perforated work surface is coupled to the frame structure by a hinge which permits the work surface to swing away from the catch basin for easy access thereto. The position of this hinge and supporting structure for the work surface is such that the hinge is not loaded by the weight of the work surface or any objects that may be placed thereon. The frame structure may also include a vertical ridge surrounding the periphery of the work surface to prevent any object thereon from falling off and to minimize spillage, and sidewalls to form a cabinet structure whereby one sidewall has an opening permitting access to the stopcock.

The lower assembly is comprised of a frame or stand structure connected to several reinforcing panels, which when assembled, yields a cabinet-like structure that is supported on wheels. Within the cabinet is an area reserved for shelving and/or drawers for the storage of tools and supplies, and an area for a removable reservoir to store the liquid drained from the upper unit for subsequent disposal. The top panel of the lower assembly features a flat reinforced work surface with a drain pipe and connector tube located to funnel the flow of liquid from the upper assembly to the removable reservoir.

Other desirable features and constructional details of the portable workbench according to the present invention will become apparent from the description below together with the accompanying drawings.

DESCRIPTION OF THE PREFERRED EMBODIMENTS

Figure 1:
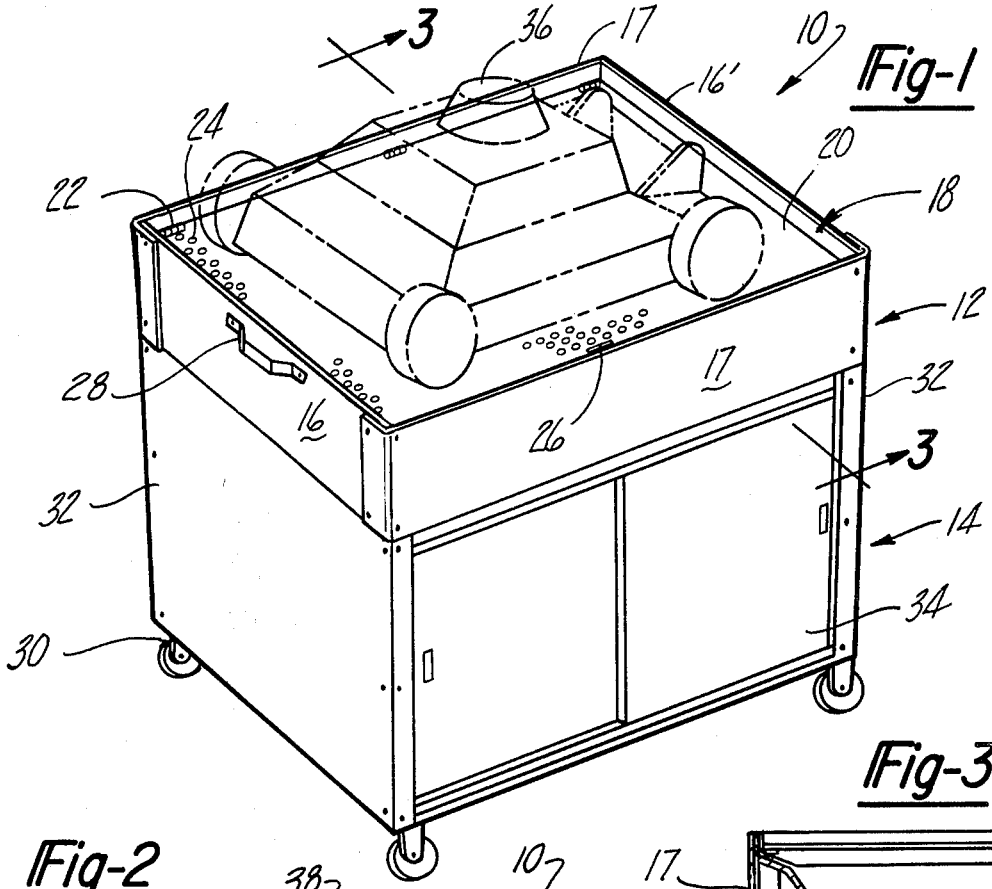
FIG. 1 is a perspective view of the preferred embodiment of a portable workbench according to the present invention.

Referring to FIG. 1, a perspective view of a portable workbench 10 according to the present invention is shown. Workbench 10 includes an upper framed and panelled structure 12 and a lower framed cabinet structure 14. The upper framed and panelled structure 12 is comprised of similar sidewalls 16 and 16' and front and rearwalls 17 fastened to a framed structure 18 including a plurality of depending legs 19; framed structure 18 has a work surface 20 pivotally attached thereto by hinges 22. Work surface 20 is perforated with a multiplicity of holes or openings 24 therein to permit any liquid and/or small debris to drain therethrough. Work surface 20 may be pivoted upwardly along the axis of hinges 22 by lifting the work surface with a retractable grip 26 provided therein. Work surface 20 may be constructed from any suitable material capable of supporting heavy mechanisms and machines while maintaining a perforated structure such as a perforated sheet or mesh metal grating. The framed and panelled upper structure may also be provided with one or more handles 28 to assist in moving the workbench as a whole unit, or removing the upper structure 12 from the lower cabinet structure 14.

The lower cabinet structure 14 is supported by a plurality of casters or wheels 30. The cabinet structure 14 may be constructed from any suitable material which will support the upper framed and panelled structure 12 and any appropriate object placed thereon. Cabinet structure 14 has a plurality of sidewalls 32 and a flat backwall 33 and may additionally include a set of sliding doors 34 or other like means for providing access to the interior.

A lawnmower 36 (shown in phantom lines) is disposed on work surface 20, and represents one of a wide variety of mechanisms that may be worked on, repaired, or disassembled on workbench 10. For example, workbench 10 provides a convenient means for changing the oil in the engine of lawnmower 36, by permitting the oil to be drained through work surface 20. It should be noted that lawnmower 36 may be worked on from all sides of workbench 10, thus alleviating the necessity of rearranging the position of the lawnmower or other piece of heavy equipment to obtain a better working position. It will also be appreciated by those skilled in the art that the provision of wheels 30 not only provide mobility for workbench 10, but also permits clearance for adequate toe room under cabinet structure 14 to permit a person to work closely at the workbench. One or more of wheels 30 may be provided with a conventional locking mechanism to preclude rolling and to fix workbench 10 in a desired stationary position.

Figure 2:
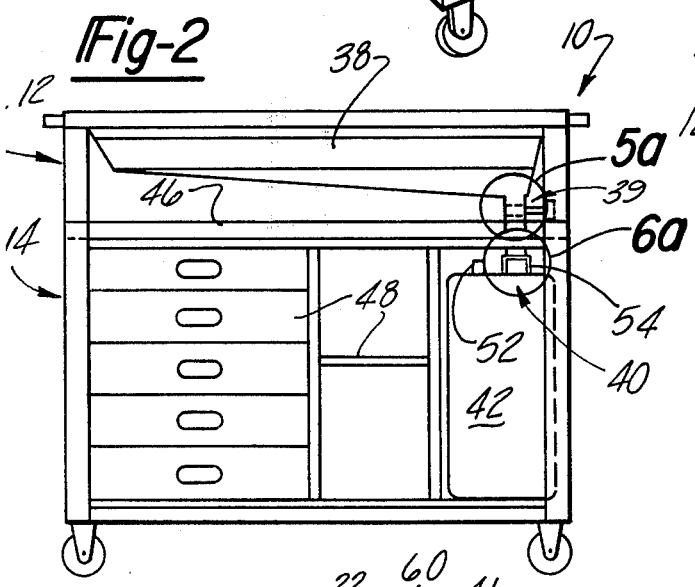
FIG. 2 is a front elevation view of the portable workbench of FIG. 1 with the sliding doors and panels removed.

Referring to FIG. 2, a front elevation of workbench 10 is shown with the doors 34 removed. In particular, the relationship between a catch basin 38, a screened drain and stopcock assembly 39 (FIG. 5), a drain funnel and connector tube assembly 40, and a removable reservoir 42 (FIG. 6) is illustrated. The removable reservoir 42 may be of any convenient shape, such as that of a narrow 5 gallon container and may have a handle 52 to assist in carrying the reservoir 42 to dispose of the liquid and debris therein. The removable upper structure 12 is normally positioned on top of a reinforced work surface pan 46 of the lower cabinet structure 14; in this instance the screened drain and stopcock assembly 39 and the drain funnel and connector tube assembly 40 align and interconnect to direct the fluid from the catch basin 38 to an opening 54 of the removable reservoir 42 which is in a fixed (but removable) position within the lower cabinet structure 14. Also illustrated in FIG. 2 is an area 48 of the lower cabinet structure 14 which can be adapted for shelving and/or drawers for storage of tools and supplies. As will be seen the lower cabinet 14 also has a flat drain pan 46 which is peripherally flanged whereby some fluids can be accumulated and drained through its opening 92.

Figure 3:
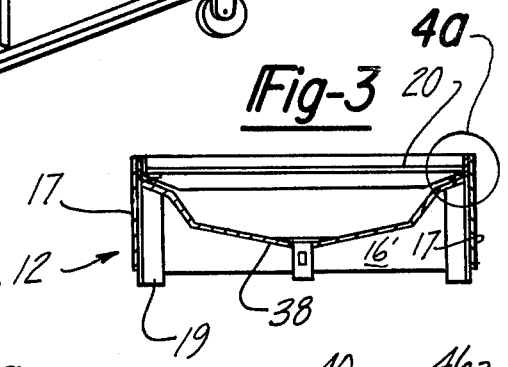
FIG. 3 is a fragmentary, sectional side elevation view of the upper section of the portable workbench of FIG. 1 taken generally along the line 3—3.

Referring to FIG. 3, the relationship of the work surface 20 and the catch basin 38 of the upper structure 12 is illustrated. Note that the width of side panels 16, 16' and 17 does not extend the full length of supporting legs 19 of the structure 12 to compensate for the depth of the work surface pan 46 whereby a flush meeting of the sidewalls 16, 16' and 17 of the upper structure 12 and 32, 33 of the lower cabinet 14 is achieved when the two (12 and 14) are positioned together. Note that with the upper structure 12 removed, the flat pan 46 provides a work support surface with its flanged periphery not only permitting some fluid accumulation during drainage, but also acting as a retainer for the supported apparatus and components thereof.

Figure 4:
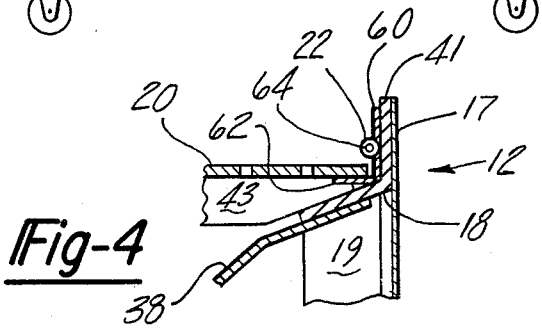
FIG. 4 is a fragmentary sectional side elevational view to enlarged scale of the portion of the upper section of FIG. 3 shown in the area designated 4*a;*

Referring to FIG. 4, the interconnection of the hinged work surface 20 and the catch basin 38 of upper structure 12 is illustrated. As shown, the framed structure 18 is comprised of a formed angle frame 41 connected to the plurality of legs 19 by any conventional means such as welding. A plurality of reinforcing ribs 43 are connected to the underside of work surface 20 and are angled at the ends to complement the similarly angulated horizontal top edge of the formed angle frame 41 which is thus angulated to facilitate draining. Hinges 22 are comprised of first and second interlocking plates 60 and 62 coupled by a pin 64. The first plate 60 is mounted by conventional means to the one side of the vertical edge of the formed angle frame 41. Similarly, the second plate 62 is mounted to the bottom of the corresponding side of work surface 20. With the arrangement described above, hinge 22 is not used to support work surface 20 or any objects placed thereon when the said work surface is in the resting position. Catch basin 38 is shown mounted by conventional means, such as bolting the flanged portion of the said catch basin to the horizontal bottom edge of the formed angle frame 41 thus preventing seepage between the mating surfaces.

Figure 5:
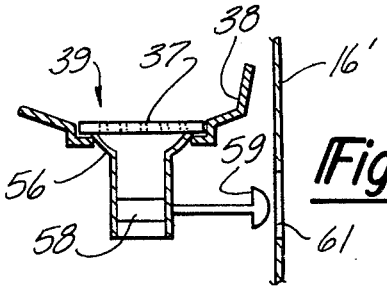
FIG. 5 is a fragmentary sectional view to enlarged scale of the portion of the upper section of FIG. 2 shown in the area designated 5*a* and illustrating the screened drain and stopcock assembly.

Referring to FIG. 5, the screened drain and stopcock assembly 39 is shown. The upper end of the drain 39 may be secured to the catch basin 38 by adhesive bonding or a threaded connection. A removable screen 37, such as that provided by a plate with a plurality of perforations, is provided to fit within the upper end of the drain 39 to catch small parts that may have fallen into the catch basin 38. A stopcock 58 is provided within the lower tubular portion of the drain 56 to regulate the flow of liquid that is collected in catch basin 38. A handle extension 59 is connected to the stopcock 58 to provide accessibility through an opening 61 in side panel 16'. The stopcock 58 may be closed by turning handle extension 59 to stop the flow of liquid and debris being drained so that the reservoir 42 may be removed from workbench 10 to dispose of the liquid stored therein. The stopcock 58 can also be closed when the upper framed and panelled structure 12 is removed for use in conjunction with a conventional workbench, or on the floor under a motor vehicle to permit collection of liquid and debris from the vehicle and its parts that may be placed on the work surface 20.

Figure 6:
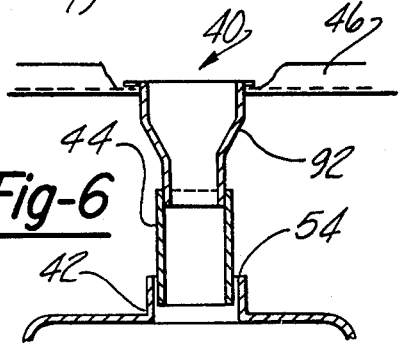
FIG. 6 is a fragmentary sectional view to enlarged scale, with some parts broken away, of the lower section of FIG. 2 shown in the area designated 6*a* and illustrating the drain funnel and extension tube directing fluid to the removable reservoir.

Referring to FIG. 6, a detail of assembly 40 of the drain funnel and connector tube assembly is shown. An upper end of the drain funnel 92 may be secured to the reinforced work surface pan 46 by adhesive bonding, welding, or a threaded connection. A connector tube 44, which may be of a flexible construction, is secured to the lower end of the drain funnel 92 utilizing any conventional means such as a circular clamp or adhesive bonding. The lower end of the connector tube 44 is adapted to be inserted into the opening 54 of reservoir 42 to direct the flow of liquid and debris into the reservoir 42.

Figure 7:
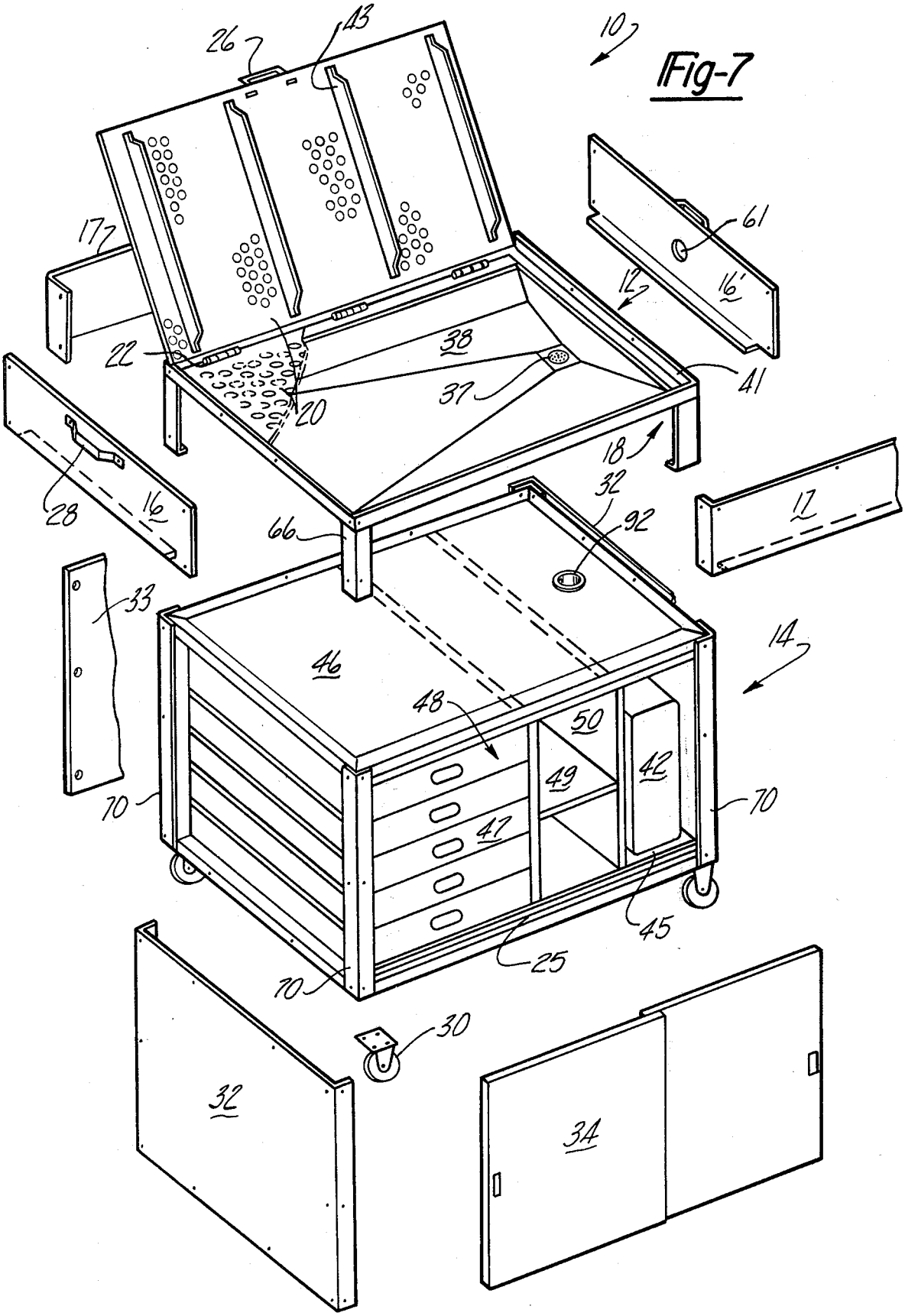
FIG. 7 is an exploded assembly perspective view of the portable workbench of FIG. 1 indicating the perforated work surface pivoted upwardly and illustrating the breakdown of the workbench into panels and components that can be self assembled.

Referring to FIG. 7, an exploded assembly perspective view of workbench 10 is shown. Particularly illustrated is the breakdown of the removable upper framed and panelled structure 12 and the lower framed cabinet structure 14 into panels and components which can be packaged in low profile containers to minimize warehousing and transportation costs, and may be assembled by simply bolting the parts together.

The upper framed and panelled structure 12 in the preferred embodiment is comprised of a framed structure 18 with a plurality of panels 16, 16' and 17 which may be bolted together. The framed structure 18 may consist of four horizontally disposed, formed angle iron members that can be welded to form a quadrilateral formed angle frame 41 that is further connected, by welding, to the four vertically disposed legs 19 also of suitable construction such as formed angle iron. As noted work surface 20, which may be a perforated plate, is connected to the formed angle frame 41 by the plurality of hinges 22. Work surface 20 is shown in a work support position (in phantom), and in a lifted position. In the lifted position, the work surface 20 is pivoted upwardly to display the plurality of generally parallel reinforcing ribs 43 that may be welded or otherwise secured to the underside of the work surface 20. The reinforcing ribs 43 strengthen and stiffen the work surface 20 as may be necessary to support heavy mechanisms on the order of five hundred pounds. The reinforcing ribs 42 may be constructed of any suitable material and shape such as flat stock iron that is chamfered or angulated on each end for engagement with the inwardly projected horizontal ridges of the formed angle frame 41 when the work surface 20 is in its lowered position as shown in FIG. 4. When the work surface 20 is in the latter position, the vertical ridge of the formed angle frame 41 also provides a barrier around the periphery of work surface 20 which prevents any tools or objects placed thereon from inadvertently falling off and minimizing slippage therefrom.

Positioned below the work surface 20, within the framed and panelled structure 12, is the self draining catch basin 38 which as noted may be secured by bolting the flanged portion of the said catch basin to the inwardly horizontal bottom edge of the formed angle frame 41. The shape of the catch basin 38 is generally inclined such that the liquid and debris collected is directed by gravity to the screened plate 37 of the drain opening. The removable screened plate 37, which is part of the screened drain and stopcock assembly 39 as shown in FIG. 5, is positioned in the catch basin 38 to trap small objects such as nuts or bolts which may have slipped through work surface 20. The handles 28 may be fastened simultaneously with the side panels 16 and 16', by bolting. Also illustrated is the opening 61 in the side panel 16' (which is secured to the draining side of the upper framed and panelled structure 12) to allow accessibility to the stopcock handle extension 59 which is detailed in FIG. 5.

The lower framed cabinet structure 14 in the preferred embodiment is comprised of an assembly of four vertically disposed leg members 70 (which may be of any suitable construction such as formed angle iron), a plurality of reinforcing sidewalls 32 and 33, a lower horizontally disposed reinforcing plate 45, and the reinforced work surface pan 46, that can be bolted or otherwise secured together and supported by the plurality of casters or wheels 30. As noted one or more of the casters or wheels 30 may be equipped with a locking device to maintain workbench 10 in a stationary position. The framed cabinet structure 14 may have one or more reinforcing partitions 50 creating an area reserved for the removable reservoir 42 as well as areas for storage. The framed cabinet structure 14 may have a plurality of shelves 49 for storage of equipment and may also have a plurality of drawers 47 for keeping tools readily available. The lower horizontally disposed reinforcing plate 45 and the reinforced work surface 46 may be of any suitable construction such as stamped sheet metal. Similarly, the reinforcing partitions 50 and the shelves 49 may also be stampings. The drain funnel 92, which is part of the drain funnel and connector tube assembly 40, shown in FIG. 6, is positioned on one side of the reinforced work surface pan 46 to permit the liquid and debris to flow from the catch basin 38 located within the upper structure 12 into the removable reservoir 42. As illustrated, the sliding doors 34 are positioned within the tracks 25 to prevent the loss of tools and equipment by theft or in-transit dislodging, and add to the appearance of workbench 10. In one form of the present invention, catch basin 38, the screened drain and stopcock assembly 39, the drain funnel and connector tube assembly 40, and the removable reservoir 42 are constructed from a suitable plastic or other material which is resistant or inert to the liquid and debris in which they will come into contact.

It will be appreciated, by those skilled in the art, that various changes and modifications may be made to the portable workbench structure described in this specification without departing from the spirit and scope of the invention as defined by the appended claims. The various embodiments which have been set forth were for the purpose of illustration, and were not intended to limit the invention.

What is claimed is:

1. A portable workbench, comprising:

a stand structure supported by a plurality of wheels;

a work surface, disposed on said stand structure, and having perforations therein for permitting liquid to drain therethrough; said work surface being generally planar and, except for said perforations, defining without interruption a continuous surface between opposite edges adapted to receive and removably support workpieces of different shapes and sizes;

a self-draining basin separate from and located beneath said work surface, having a drain opening and mounted to said stand structure under said work surface, for receiving said liquid drained through said work surface and directing said liquid to said drain opening; and a removable reservoir disposed below and separated from said self-draining basin and said work surface for collecting liquid drained through said drain opening and storing said liquid for subsequent disposal whereby said reservoir can be removed and drained without removal of said work surface and said basin from said stand structure.

2. The portable workbench according to claim 1, wherein a drain pipe connects said drain opening of said self-draining basin to said removable reservoir.

3. The portable workbench according to claim 2, wherein said drain pipe includes spiggot means for controlling the flow of said liquid to said reservoir.

4. The portable workbench according to claim 2, wherein said drain pipe is constructed from a flexible material.

5. The portable workbench according to claim 1 wherein said self-draining basin includes perforated means, covering said drain opening, for preventing small objects from falling into said removable reservoir.

6. A portable workbench, comprising:

a stand structure supported by a plurality of wheels;

a work surface, disposed on said stand structure, and having perforations therein for permitting liquid to drain therethrough;

a self-draining basin, having a drain opening and mounted to said stand structure under said work surface, for receiving said liquid drained through said work surface and directing said liquid to said drain opening;

a removable reservoir disposed below said self-draining basin for collecting liquid drained through said drain opening and storing said liquid for subsequent disposal;

said stand structure comprising a plurality of generally parallel leg members supported by said wheels and joined at the top to a corresponding plurality of horizontally disposed support members forming a quadri-lateral structure for supporting said work surface;

said stand structure further including an upper and lower horizontally disposed platform joined to said leg members, said lower platform providing support for said removable reservoir, said stand structure forming a detachable top section and a portable bottom section, and with said detachable top section including said work surface and said catch basin, said upper platform defining a second work surface when said top section is removed.

7. The portable workbench of claim 6 with said upper platform having a drain assembly adapted to communicate with said removable reservoir.

8. A portable workbench, comprising:

a cabinet assembly comprising a lower cabinet assembly supported by a plurality of wheels and an upper removable work section, said upper section including a work surface having perforations therein for permitting liquid to drain therethrough, and a self-draining basin, having a drain opening and mounted under said work surface for receiving said liquid drained through said work surface and directing said liquid to said drain opening, said lower cabinet assembly having a removable reservoir disposed below said self-draining basin for collecting liquid drained through said drain opening and storing said liquid for subsequent disposal, said lower cabinet assembly having a second work surface having a drain assembly in communication with said reservoir, said second work surface adapted to support workpieces when said upper section is removed.

9. The portable workbench according to claim 8, wherein said cabinet structure includes a platform for supporting said removable reservoir.

10. The portable workbench according to claim 8, wherein said work surface is supported in a resting position by an inwardly projecting horizontal ridge portion of said stand structure extending around the periphery of said work surface.

11. The portable workbench according to claim 10, wherein said stand structure includes a vertical ridge portion adjoining said horizontal ridge portion and surrounding the periphery of said work surface, and extending above said work surface.

12. The portable workbench according to claim 11, wherein said work surface is coupled to said stand structure by hinge means for permitting said work surface to pivot away from said self-draining basin.

13. The portable workbench according to claim 12, wherein said hinge means is comprised of first and second interlocking plates coupled by a pin, and said first plate is mounted to said vertical ridge portion of said stand structure and said second plate is mounted to the bottom of said work surface.

14. The portable workbench according to claim 12, wherein said work surface includes rib means for reinforcing said work surface.

15. The portable workbench according to claim 14, wherein said rib means is comprised of a plurality of generally parallel reinforcing ribs secured to the bottom of said work surface.

16. The portable workbench according to claim 15, wherein said reinforcing ribs engage said horizontal ridge portion of said stand structure when said work surface is in said resting position whereby said work surface is substantially supported by said horizontal ridge portion.

* * * * *